US007978990B2

(12) United States Patent
Tajima

(10) Patent No.: US 7,978,990 B2
(45) Date of Patent: Jul. 12, 2011

(54) IMAGE FORMING APPARATUS HAVING A CONTROL SECTION WHICH DETECTS OVERCURRENT IN A MOTOR AND CONTROLS THE MOTOR IN RESPONSE TO DETECTION OF THE OVERCURRENT

(75) Inventor: Shinichi Tajima, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 413 days.

(21) Appl. No.: 12/314,325

(22) Filed: Dec. 8, 2008

(65) Prior Publication Data

US 2009/0148173 A1 Jun. 11, 2009

(30) Foreign Application Priority Data

Dec. 10, 2007 (JP) ..... 2007-318260

(51) Int. Cl.
*G03G 15/00* (2006.01)

(52) U.S. Cl. ..... 399/36; 399/100; 399/177; 399/345

(58) Field of Classification Search ..... 399/100, 399/177, 345, 411; 318/10
See application file for complete search history.

(56) References Cited

U.S. PATENT DOCUMENTS 4,864,363 A * 9/1989 Shinada ..... 355/133
6,407,523 B1 * 6/2002 Allan ..... 318/430
6,963,705 B2 * 11/2005 Quinones ..... 399/100
7,660,547 B2 * 2/2010 Takiguchi et al. ..... 399/100

FOREIGN PATENT DOCUMENTS

JP 01-116659 5/1989

* cited by examiner

*Primary Examiner* — David M Gray
*Assistant Examiner* — G. M. Hyder
(74) *Attorney, Agent, or Firm* — Smith, Gambrell & Russell, LLP

(57) ABSTRACT

An image forming apparatus includes: a rotation shaft (71); a movable body (72) that is attached to the rotation shaft (71), that is provided with a cleaning member (73), and that moves with rotation of the rotation shaft (71); a motor M for rotating the rotation shaft (71); a control section (8) for controlling rotation of the motor M; a current detecting section (77) for detecting a current flowing through the motor M; and a time counting section for counting time. Here, the control section is provided with: an overcurrent detection checking function; a time counting function; a predetermined position attainment checking function; a reciprocation control function; an erroneous detection checking function for performing erroneous detection checking operation in which an overcurrent detected while the movable body is moving forward in the reciprocation thereof is checked while the movable body is moving backward in the reciprocation thereof; and a repeating function for performing the erroneous detection checking operation once or a plurality of times in a repeating fashion.

11 Claims, 6 Drawing Sheets

IMAGE FORMING APPARATUS HAVING A CONTROL SECTION WHICH DETECTS OVERCURRENT IN A MOTOR AND CONTROLS THE MOTOR IN RESPONSE TO DETECTION OF THE OVERCURRENT

This application is based on Japanese Patent Application No. 2007-318260 filed on Dec. 10, 2007, the contents of which are hereby incorporated by reference.

BACKGROUND OF THE INVENTION

1. Field of the Invention

The present invention relates to an image forming apparatus such as a printer, a copier, a facsimile machine, and a multifunctional system that performs cleaning of a member by using a motor for rotating a rotation shaft to move a movable body.

2. Description of Related Art

Image forming apparatuses are sometimes provided with a mechanism that uses a motor or the like to automatically remove stain caused by dust of toner, external additives of toner (e.g., silica), and the like. For example, in an image forming apparatus in which a photoconductive drum is charged by corona discharge from a wire, electrostatic force generated by a voltage applied to the wire may sometimes cause a substance such as dust of silica to adhere to the wire, and this substance adhered to the wire is automatically removed by use of a motor and the like.

An example of an image forming apparatus in which a wire is cleaned by use of a motor and the like is disclosed in JP-A-H01-116659. Specifically, JP-A-H01-116659 discloses a wire cleaning unit for use in a corona discharge device incorporated in an image forming apparatus that performs image recording on recording paper, the wire cleaning unit including: cleaning means for cleaning a charging wire of the corona discharge device; a motor for moving this cleaning means; overcurrent detecting means for detecting an overcurrent flowing through the motor; time counting means that starts counting time substantially at the same time the cleaning means starts moving; failure detecting means for judging whether or not the cleaning device has stopped halfway when an overcurrent is detected by the overcurrent detecting means and according to counted time; and control means that, in response to detection of failure, permits image recording to be performed on recording paper so sized that the image recording can be performed thereon without being negatively affected by the failure and prohibits image recording from being performed on recording paper so sized that the image recording, if performed thereon, will be negatively affected by the failure. This structure helps prevent abnormality from occurring in a recorded image due to an abnormal stop of cleaning operation.

Here, in some of the cases where a wire of a charging device and a glass portion of a laser unit functioning as an exposure device are automatically cleaned by using, for example, a motor, cleaning is performed by driving the motor for a given time to move a movable body provided with a cleaning member.

However, the amount of load on the motor varies depending on, for example, how dirty a target to be cleaned is, and time necessary for the cleaning member to be moved over a predetermined distance also varies with the amount of load. Thus, if the motor is driven only for the given time, the movable body sometimes cannot reach a terminal position, and thus cleaning is stopped halfway, which is inconvenient.

Also, there is a case where a stopper or the like is provided at the end point of the travel of the movable body and cleaning is judged to have been completed when an overcurrent is detected flowing through the motor. Inconveniently, however, an overcurrent is sometimes detected before cleaning is completed, due to noise from noise sources incorporated in the image forming apparatus such as a charging unit and a transfer unit that emit high voltages, and noise from printing paper that is charged with electrostatic.

Incidentally, the invention disclosed in JP-A-H01-116659 only attempts to prevent generation of an abnormal recorded image by selecting printing paper sized such that image formation thereon will not be negatively affected by an abnormal stop of the cleaning means according to how long the cleaning means has moved, that is, the time counted from the start of a travel of the cleaning member to detection of an overcurrent, and according to how fast the cleaning means has moved (see lines 1 to 3 of the left column in page 2); detection errors caused by noise or the like are not considered in the invention. That is, in the invention disclosed in JP-A-H01-116659, since the rotation direction of a motor is reversed as soon as an overcurrent is detected, it is impossible to correctly judge whether the overcurrent has occurred because of a large load, noise, or a failure, and it is also impossible to correctly judge whether or not the motor should be permitted to continue rotating.

SUMMARY OF THE INVENTION

An object of the present invention is to provide an image forming apparatus that securely detects erroneous detection of an overcurrent caused by noise or the like, and also, securely performs cleaning even if a load on a motor varies depending on, for example, how dirty a target to be cleaned is.

To achieve the above object, according to the present invention, an image forming apparatus includes: a rotatably-supported rotation shaft around which a spiral protrusion or a spiral groove is formed; a movable body that is attached to the rotation shaft, that is provided with a cleaning member, and that moves with rotation of the rotation shaft, keeping the cleaning member in contact with a target to be cleaned; a forward/backward rotation motor for rotating the rotation shaft; a control section for controlling rotation of the motor using a set time as a guideline such that the movable body moves to a predetermined position in cleaning operation; a current detecting section for detecting a current flowing through the motor; and a time counting section for counting time. Here, the control section is provided with: an overcurrent detection checking function for checking that the current detecting section has detected an overcurrent flowing through the motor; a motor drive time checking function for checking that motor drive time from a start of driving of the motor to detection of an overcurrent is shorter than a time obtained by subtracting a predetermined time from the set time; a predetermined position attainment checking function for checking via the motor drive time checking function whether or not the movable body is positioned at the predetermined position when the overcurrent is detected; a reciprocation control function for making the motor stop rotating to make the motor rotate backward for a given time and then rotate forward again when it is checked that the motor drive time from the start of the driving of the motor to the detection of the overcurrent is shorter than the time obtained by subtracting the predetermined time from the set time; an erroneous overcurrent detection checking function for performing erroneous detection checking operation for checking, in a case where an overcurrent was detected while the movable body was moving forward in reciprocation thereof, whether or not an overcurrent is also detected while the movable body is moving backward in the reciprocation thereof; and a repeating function for performing erroneous overcurrent detection checking operation once or a plurality of times in a repeating fashion.

With this structure, in overcurrent detection, if it is checked that the motor drive time from a start of the driving of the motor to detection of an overcurrent is shorter than the time obtained by subtracting the predetermined time from the set time, the control section performs once or a plurality of times in a repeating fashion an erroneous overcurrent detection checking operation in which the control section makes the motor stop rotating to make the motor rotate backward for a given length of time, and then makes the motor rotate forward again. This makes it possible for erroneous detection of an overcurrent caused by noise or the like to be detected without fail. In addition, in driving the motor, unlike in conventional cleaning operation in which a motor is driving only for a set time, a predetermined time is set as a margin for error, and thus cleaning operation can securely be completed. As a result, it is possible to securely prevent cleaning operation from being stopped before the movable body reaches the predetermined position.

According to the present invention, in the image forming apparatus structured as described above, it is preferable that the control section make the motor stop rotating in a case where an overcurrent is detected flowing through the motor both in forward and backward rotations thereof in the erroneous detection checking operation. With this structure, in the case where an overcurrent is detected flowing through the motor both when the motor is rotating forward and when it is rotating backward, which suggests that some trouble has occurred in a mechanism for moving the movable body, it is possible to prevent an overcurrent from continuing flowing through the motor for a long time.

According to the present invention, in the image forming apparatus structured as described above, it is preferable that, in the erroneous detection checking operation, when the current detecting section detects an overcurrent flowing through the motor, the control section make the motor rotate backward so as to make the movable body move to a standby position. With this structure, since the movable body is made to move to the standby position in the case where an overcurrent is detected flowing through the motor in the erroneous detection checking operation, the suggesting that some trouble such as an abnormally large load has occurred, the movable body can at least be prevented from interfering with image forming operation. In addition, it is possible to prevent the motor from being overheated because an overcurrent continues flowing therethrough due to abnormal torque.

According to the present invention, in the image forming apparatus structured as described above, it is preferable that the control section make the motor stop rotating in a case where, in the erroneous detection checking operation, an overcurrent is detected flowing through the motor both while the motor is rotating forward and while the motor is rotating backward. With this structure, in the case where an overcurrent is detected flowing through the motor both while the motor is rotating forward and while it is rotating backward, the case suggesting that some trouble has occurred in the mechanism for moving the movable body, it is possible to prevent an overcurrent from continuing flowing through the motor for a long time.

According to the present invention, in the image forming apparatus structured as described above, it is preferable that the control section make the motor continue rotating until an overcurrent is detected in a case where the current detecting section has not detect an overcurrent flowing through the motor when the set time has elapsed. With this structure, since the motor is allowed to continue rotating until an overcurrent is detected, the movable body is allowed to move to the predetermined position, which makes it possible to prevent cleaning operation from being stopped halfway in the case where no overcurrent has been detected flowing through the motor even when the set time has elapsed, the case suggesting that the movable body is caused to move at a lower speed because of a large load.

According to the present invention, in the image forming apparatus structured as described above, it is preferable that the control section make the motor stop rotating in a case where the current detecting section has not detected an overcurrent flowing through the motor when a time twice as long as the set time has elapsed from a start of driving of the motor. With this structure, since the control section makes the motor stop being driven, it is possible to prevent the motor from being overheated in the case where no overcurrent has been detected flowing through the motor when a time twice as long as the time has elapsed from a start of the driving of the motor, the case suggesting that some trouble has occurred in the current detecting section or that the load is large, where there is a possibility that an overcurrent will continue flowing through the motor. However, in this case, the motor is made to stop being driven, and thereby, it is prevented from being overheated.

According to the present invention, it is preferable that the image forming apparatus structured as described above include a display section for displaying a state of the apparatus. Here, the display section displays an alert message in a case where the current detecting section detects an overcurrent flowing through the motor in the erroneous detection checking operation. With this structure, in the case where the cleaning member cannot perform proper cleaning operation, an alert message displayed on the display section enables the user to be informed that image formation will be negatively affected. In a case where an overcurrent flows through the motor more than necessary, an alert message displayed on the display section enables the user to be informed that the cleaning mechanism needs to be checked.

According to the present invention, it is preferable that the image forming apparatus structured as described above include for forming a toner image: a photoconductive drum functioning as an image carrier; and an exposure device that performs scanning and exposure of the photoconductive drum by use of laser light according to image data of an image to be formed. Here, a plate-shaped member that transmits light is attached to the exposure device at a portion thereof from which laser light is emitted toward the photoconductive drum, that the plate-shaped member be in contact with the cleaning member of the movable body, and that the plate-shaped member be the target to be cleaned. With this structure, since cleaning of the plate-shaped member of the exposure device can be securely performed without being negatively affected by noise and the like, high-quality image formation can be maintained. In addition, in the case where some trouble has occurred in the mechanism for moving the movable body, since the trouble can be detected without fail, the exposure device can be quickly repaired and restarted.

According to the present invention, it is preferable that the image forming apparatus structured as described above include for forming a toner image: a photoconductive drum functioning as an image carrier; and a charging device for charging the photoconductive drum. Here, the charging device is provided with a discharge wire that is stretched along an axial line direction of the photoconductive drum, the discharge wire is in contact with the cleaning member of the movable body, and the discharge wire is the target to be cleaned. With this structure, since the cleaning member securely cleans the discharge wire of the charging device without being negatively affected by noise and the like, high-quality image formation can be maintained. In addition, in the case where some trouble has occurred in a mechanism for moving the movable body, the trouble can be detected without fail, and thus the charging device can be quickly repaired and restarted.

According to the present invention, in the image forming apparatus structured as described above, it is preferable that the charging device be provided with a discharge wire and a grid wire that are stretched along the axial line direction of the photoconductive drum substantially parallel to each other, that the discharge wire and the grid wire be each the target to be cleaned, and that a first cleaning member with which the discharge wire is in contact and a second cleaning member with which the grid wire is in contact be attached to the movable body such that the discharge wire and the grid wire are simultaneously cleaned. With this structure, even in the case where the charging device is of a type that is provided with a discharge wire and a grid wire, these two wires can be cleaned simultaneously, and thus the charging device can be securely cleaned. As a result, high-quality image formation can be maintained.

According to the present invention, in the image forming apparatus structured as described above, it is preferable that the first cleaning member and the second cleaning member be arranged in two separate lines along and displaced from each other in a direction in which the movable body reciprocates. With this structure, since the first and second cleaning members, which are displaced from each other, reciprocate to clean the wires, the wires can be securely cleaned.

DETAILED DESCRIPTION OF PREFERRED EMBODIMENTS

Hereinafter, a description will be given of an embodiment of the present invention with reference to the drawings. It should be understood that factors such as structures and arrangements described in this embodiment are not meant to limit the scope of the present invention, but are merely examples used for describing the present invention.

Figure 1:
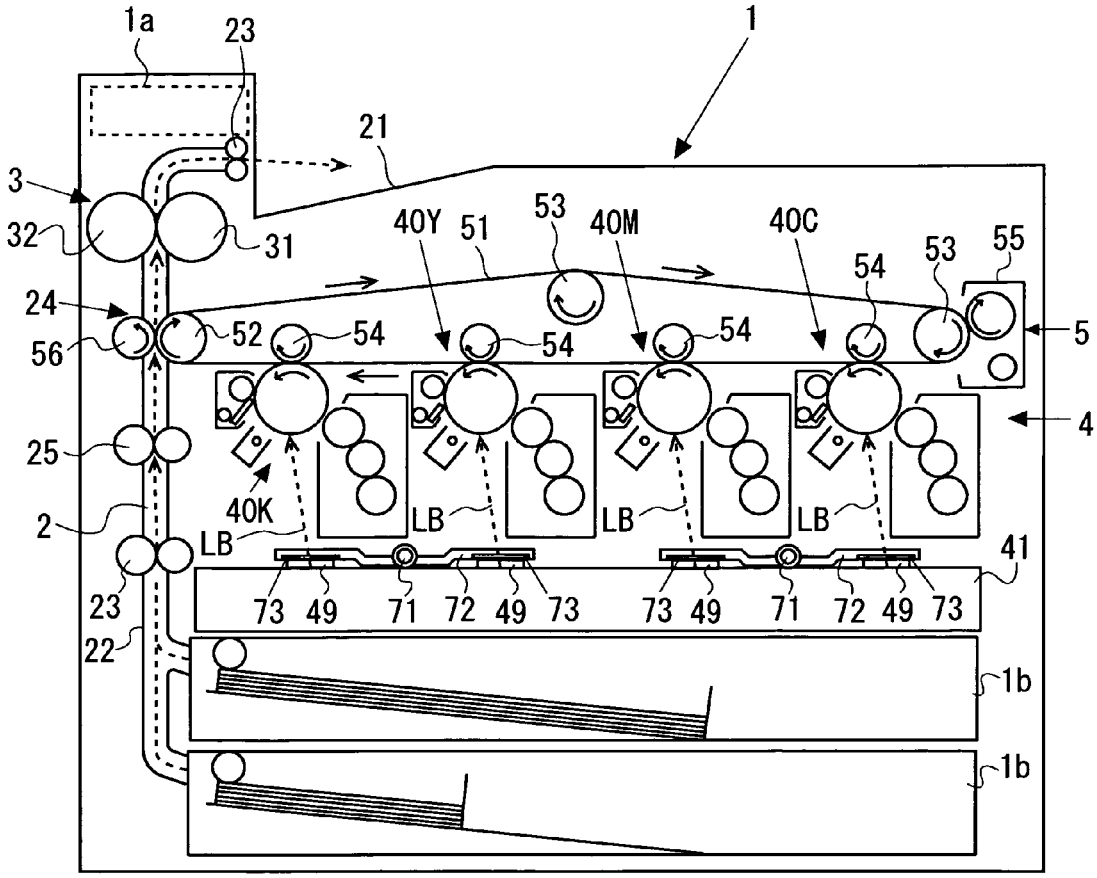
FIG. 1 is a front sectional view schematically showing the structure of a printer embodying the present invention.
Figure 2A:
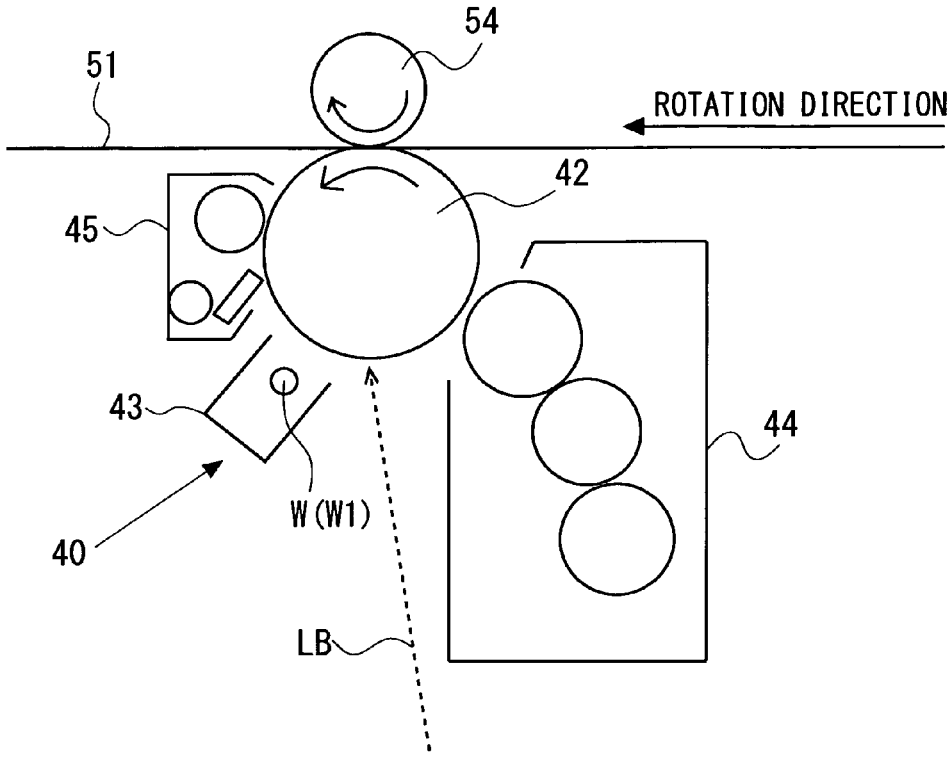
FIG. 2A is an enlarged sectional view schematically showing an image forming unit embodying the present invention.
Figure 2B:
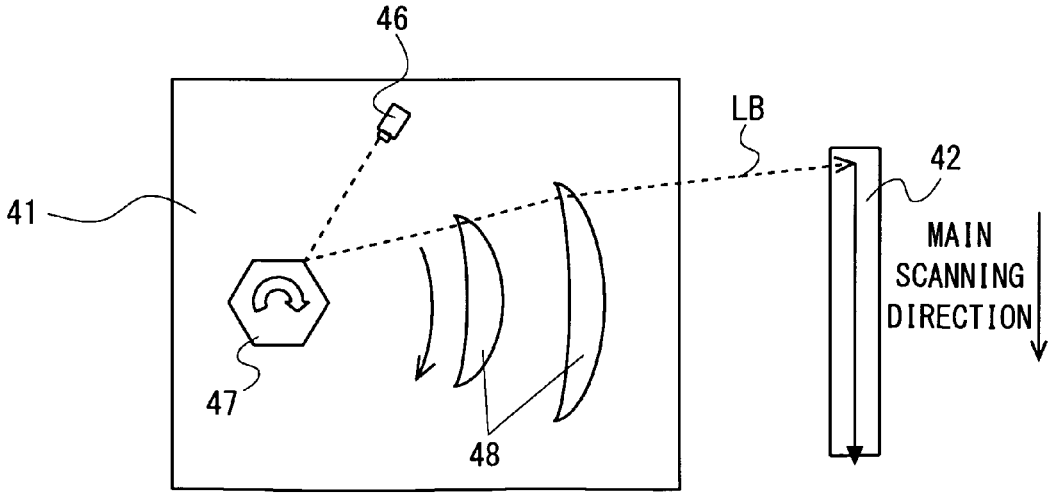
FIG. 2B is a diagram schematically showing a laser unit embodying the present invention.

First, with reference to FIGS. 1, 2A, and 2B, a description will be given of outline of the structure and operation of a printer 1 (which corresponds to an image forming apparatus) of this embodiment. FIG. 1 is a front sectional view schematically showing the structure of the printer 1 embodying the present invention. FIG. 2A is an enlarged sectional view schematically showing an image forming unit embodying the present invention, and FIG. 2B is a diagram schematically showing a laser unit embodying the present invention.

As shown in FIG. 1, the printer 1, which has a control panel 1*a* (indicated by a broken line in FIG. 1, corresponds to the display section) disposed at the left-top of the front face of the printer 1, is of so-called tandem type, and forms a full-color image on a sheet using an intermediate transfer belt 51. The printer 1 has a sheet feeding section 1*b*, a sheet transport path 2, a fixing section 3, an image forming section 4, and an intermediate transfer section 5 as main components to perform image formation.

The control panel 1*a* displays a state of the printer 1 and also accepts control and input from the user, and has, for example, a liquid crystal display section and various keys (not shown). And, when an error has occurred, an alert message for notifying the occurrence of error can be displayed in the liquid crystal display section of the control panel 1*a*. For example, in the present invention, in the erroneous detection checking operation, when current detecting sections 66 and 77 (see FIG. 5) each detect an overcurrent flowing through a corresponding one of motors M (that is, a cleaning motor M1 and a wire cleaning motor M2 shown in FIG. 5), the display section displays an alert message. Incidentally, an overcurrent is, for example, a current larger than a rated current of each of the motors M, and a standard current value is appropriately set for judging whether or not a current is an overcurrent.

In the sheet feeding section 1*b*, which is disposed at a bottom inside a main body, sheets of various types and various sizes, such as a printer sheet, a label sheet, and an OHP sheet are stored. When the printer 1 receives an instruction to perform image formation, the sheet feeding section 1*b* sends sheets one after another to the sheet transport path 2.

The sheet transport path 2 is a path for transporting a sheet upward in the vertical direction along the left side inside the printer 1 from the sheet feeding section 1*b* to a sheet ejection tray 21 (a sheet transport direction is indicated by a broken line arrow in FIG. 1). In the sheet transport path 2, there are formed a guide plate 22 for guiding the sheet transport direction and a pair of transport rollers 23 connected to a drive mechanism (not shown) formed of a motor, gears 75, and the like to be rotated thereby. Also, a pair of resist rollers 25 are provided below a secondary transfer roller 56; the resist rollers 25 allow a sheet to enter a secondary transfer section 24 (i.e., a nip between the secondary transfer roller 56 and a driving roller 52) in a manner timed with the operation of the secondary transfer section 24. Incidentally, at the secondary transfer section 24, there is performed a secondary transfer in which toner images formed at an image forming section 4 and then primarily transferred onto an intermediate transfer belt 51 on top of one another are secondarily transferred onto the sheet.

The fixing section 3 is disposed above the secondary transfer section 24, and fixes the secondarily transferred toner images onto a sheet. The fixing section 3 has a heat roller 31 that comes in contact with a toner image on the sheet and a pressure roller 32 that is disposed to be pressed against the heat roller 31. The sheet having the toner image secondarily transferred thereonto is allowed to enter a nip between the heat roller 31 and the pressure roller 32, where the toner image is fixed on the sheet. Then, the sheet, after the fixing, is ejected onto the sheet ejection tray 21, which is the end of the image formation.

The image forming section 4 is disposed above the sheet feeding section 1*b* but below the intermediate transfer belt 51.

The image forming section 4 is formed of a plurality of image forming units 40, namely, a black image forming unit 40K, a yellow image forming unit 40Y, a magenta image forming unit 40M, and a cyan image forming unit 40C that are arranged in this order from the left side in FIG. 1 and a laser unit 41 (which serves as an exposure device) disposed below the image forming units 40. Specifically, the image forming units 40K, 40Y, 40M, and 40C, which are arranged parallel to one another between a belt-cleaning device 55 and the second transfer section 24, are in contact with the intermediate transfer belt 51. Incidentally, the image forming units 40K, 40Y, 40M, and 40C may be arranged in a different order. Detailed descriptions of the image forming units 40 and the laser unit 41 will be given later.

The intermediate transfer section 5 is formed of components such as the intermediate transfer belt 51, the driving roller 52, two driven rollers 53, four primary transfer rollers 54, and the belt-cleaning device 55. The intermediate transfer belt 51 serving as an intermediate transfer body is rotatably wound around the plurality of rollers, that is, the driving roller 52, the driven rollers 53, and the primary transfer rollers 54. As the intermediate transfer belt 51, an endless belt formed by joining two ends of a belt or an endless belt without a seam (seamless endless belt) is used.

The driving roller 52 is disposed opposite from the secondary transfer roller 56, and is disposed at a far left part of the intermediate transfer section 5 as shown in FIG. 1. The driving roller 52 is connected to the driving mechanism formed of components such as the motor (not shown) and the gears 75 to be rotated thereby. The driving roller 52 allows the intermediate transfer belt 51 to rotate clockwise in FIG. 1. On the other hand, the secondary transfer roller 56 is pressed against the driving roller 52, and a predetermined voltage is applied thereto in a secondary transfer; as a result, a toner image is transferred onto a sheet from the intermediate transfer belt 51.

As is also shown in FIGS. 2A, the primary transfer rollers 54 are disposed to face photoconductive drums 42, and the intermediate transfer belt 51 is interposed between the photoconductive drums 42 and the primary transfer rollers 54. The primary transfer rollers 54 are pressed against the intermediate transfer belt 51 toward the photoconductive drums 42. And, when a predetermined voltage (current) is applied to the primary transfer rollers 54, toner is attracted from the photoconductive drums 42 to the intermediate transfer belt 51, and thus toner images formed at the image forming units 40K to 40C are primarily transferred onto a surface of the intermediate transfer belt 51 one on top of another at predetermined timings. In this way, a full-color toner image is formed by superposing toner images of the four colors one on top of another. Incidentally, the belt-cleaning device 55 is disposed to the right of the cyan image forming unit 40C in FIG. 1, and removes and collects residual toner and the like remaining on the surface of the intermediate transfer belt 51 after a secondary transfer is carried out.

Next, with reference to FIGS. 2A and 2B, outline descriptions will be given of the structure and the operation of each of the image forming unit 40 and the laser unit 41. FIG. 2A is a partially enlarged diagram showing any one of the image forming units 40 of this embodiment, and FIG. 2B is a diagram schematically showing the structure of the laser unit 41.

First, a description will be given of each of the image forming units 40 with reference to FIG. 2A; however, since the image forming units 40K to 40C are identically structured, symbols "K", "Y", "M", and "C" will be omitted unless specifically described, and the description will be given with respect to one image forming unit 40. Incidentally, a solid line arrow in FIG. 2 indicates a direction in which each rotating member rotates.

The image forming unit 40 is formed of components such as a photoconductive drum 42 serving as an image carrier, a charging device 43, a developing device 44, and a drum cleaning device 45. In the image forming unit 40, an electrostatic latent image is formed on the photoconductive drum 42 according to image data of a letter, a figure, a pattern, and the like, that is received from an external computer (not shown), and this electrostatic latent image is developed into a visible image (i.e., a toner image) by the developing device 44.

The photoconductive drum 42, which functions as the image carrier, is a cylindrical member made by forming a photoconductive layer of, for example, amorphous silicon on an outer peripheral surface of a cylindrical conductive substrate formed of, for example, aluminum; the photoconductive drum 42 carries on a surface thereof a toner image formed of charged toner.

The charging device 43 uniformly charges the surface of the photoconductive drum 42. The charging device 43 of this embodiment is a corona discharger that has a wire W (for example, a discharge wire W1) as an electrode and a high voltage applying section 43*b* (see FIG. 5) that applies a high voltage to the wire W to induce discharge, but instead of a corona discharger, a charging device of roller type or of brush type may be used. The charging device 43 of this embodiment is provided with a wire cleaning mechanism 6 for removing a substance adhered to the wire W, of which a detailed description will be given later.

The developing device 44 contains toner therein, charges the toner to a predetermined potential, and feeds the charged toner to the photoconductive drum 42 on which a electrostatic latent image has been formed by being scanned and exposed by the laser unit 41, which will be described later. With the charged toner fed in this way, the electrostatic latent image is developed as a toner image. The drum cleaning device 45 removes residual developer (toner) remaining on the photoconductive drum 42 without being transferred onto the intermediate transfer belt 51.

Next, a description will be given of the structure of the laser unit 41 with reverence to FIGS. 1 and 2B.

The laser unit 41, which is box-shaped and functions as the exposure device, is disposed below the image forming units 40. The laser unit 41 irradiates the charged photoconductive drums 42 with laser light LB, scanning and exposing the peripheral surface of the photoconductive drums 42, and forms an electrostatic latent image according to image data of an image to be formed.

As shown in FIG. 2B, inside the laser unit 41, there are provided components such as a semiconductor laser device 46 (laser diode) for emitting the laser light LB, a polygon mirror 47 that rotates fast and has a plurality of flat reflecting surfaces for reflecting the laser light LB, fθ lenses 48, and a mirror (not shown) for reflecting the laser light LB as necessary. (Incidentally, FIG. 2B shows the structure in the case where image formation is performed for only one color, and in the case where, for example, image formation is performed for four colors, the polygon mirror 47 is shared, but the other components such as the semiconductor laser device 46, the fθ lenses 48, and the mirror are each provided one for each color.) With this structure, each of the photoconductive drums 42 is irradiated with the laser light LB from the laser unit 41, and an electrostatic latent image is formed thereon according to the image data.

Incidentally, as shown in FIG. 1, portions of the laser unit 41 from which the laser light LB is emitted toward the image forming units 40 of the four colors are each provided with a glass plate 49 (which corresponds to the plate-shaped member that transmits light), that is, four glass plates 49 are provided in total, for the purpose of preventing dust such as toner from entering the laser unit 41. The laser light LB passes through the glass plates 49 to reach the photoconductive drums 42, and thus the photoconductive drums 42 are exposed to the laser light LB. In addition, as shown in FIG. 1, for the purpose of cleaning the glass plates 49, there is provided a glass plate cleaning mechanism 7 formed of components such as rotation shafts 71, a detailed description of which will be given later.

Now, since the image forming apparatus of this embodiment is one in which the glass plates 49 of the laser unit 41 and the wire W of the charging device 43 are automatically cleaned by use of a motor, and is characterized in that such cleaning can be securely performed, a detailed description will be given below of the cleaning mechanisms of the laser unit 41 and the charging device 43.

Figure 3:
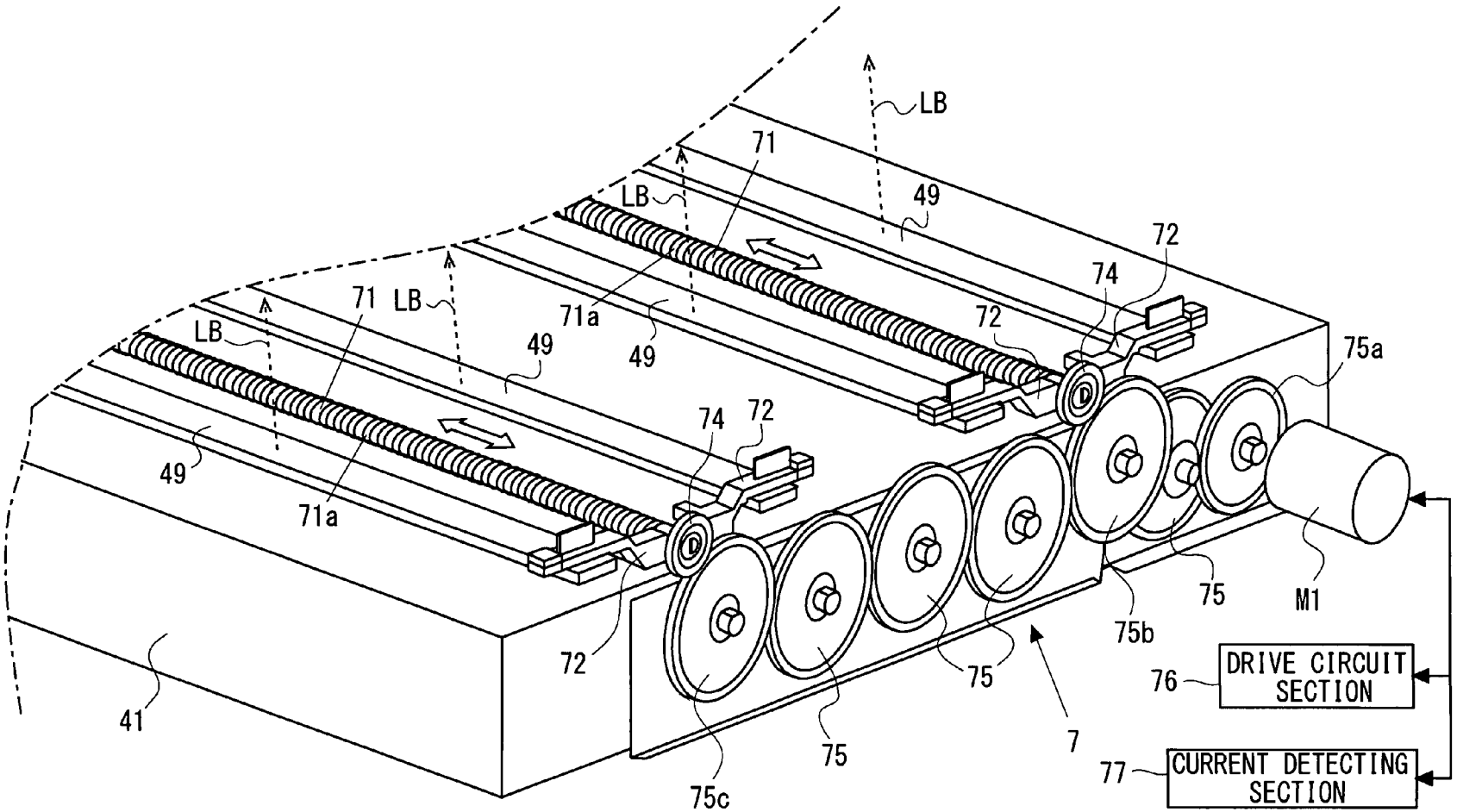
FIG. 3 is a perspective view for illustrating a glass plate cleaning mechanism embodying the present invention.

First, a description will be given of the glass plate cleaning mechanism 7 of the laser unit 41 with reference to FIG. 3. FIG. 3 is a perspective view for illustrating the glass plate cleaning mechanism 7 of this embodiment.

First, reasons will be given why it is necessary to clean the glass plates 49. In the printer 1 of this embodiment, the laser light LB is emitted through the glass plates 49, and if these glass plates 49 are stained, less amount of laser light LB reaches the photoconductive drums 42, or the stain causes the laser light LB to be reflected diffusely. This has a negative effect on image formation, and thus image quality is degraded. The glass plates 49 are stained, for example, by toner falling onto the laser unit 41 from the image forming units 40 disposed above the laser unit 41. In addition to the toner, dust of some kind is always floating inside the printer 1, and such dust may fall onto the glass plates 49. Thus, the glass plates 49 of the laser unit 41 need to be cleaned.

To satisfy the need for cleaning the glass plates 49, the printer 1 of this embodiment is provided with the glass plate cleaning mechanism 7 formed of components such as the rotation shafts 71, movable bodies 72, cleaning members 73, and a cleaning motor M1. Incidentally, cleaning of the glass plates 49 may be performed in response to an instruction inputted via the control panel 1*a*, or may be automatically performed every time image formation has been performed on a given number of sheets (for example, every several hundred to several thousand).

As shown in FIG. 3, two rotation shafts 71 around the periphery of each of which is formed a spiral protrusion (or a spiral groove) 71*a* are provided on the top face of the laser unit 41 so as to extend in a direction parallel to the length of the glass plates 49. The movable bodies 72 having two wing-like portions extending in directions perpendicular to a shaft line direction of the rotation shafts 71 are attached one to each of the rotation shafts 71.

To the bottom face of each of the two wing-like portions of each of the movable bodies 72, a cleaning member 73 formed of, for example, sponge is fitted (two in total for each movable body 72, not shown in FIG. 3, see FIG. 1), and each cleaning member 73 is in contact with a corresponding one of the glass plates 49. In other words, fitting positions of the rotations shafts 71 and the movable bodies 72 are adjusted such that the cleaning members 73 are in contact with glass plates 49. Incidentally, although the cleaning members 73 are formed of sponge in this embodiment, they may be formed of any material as long as they can remove dust such as toner off the glass plates 49 without scratching them; the cleaning members 73 may be formed as brushes, formed of a non-woven fabric such as felt, or may be formed as a resin blade.

The just described combination of a rotation shaft 71, a movable body 72, and the cleaning members 73 are provided in two sets in the glass plate cleaning mechanism 7 of this embodiment. This makes it possible to clean all the total of four glass plates 49 provided for irradiating the photoconductive drums 42 with the laser light LB.

On the other hand, on a side face of the laser unit 41, the cleaning motor M1 is provided as a drive source for rotating the rotation shafts 71. The cleaning motor M1 is a forward/backward rotation motor, and in this embodiment, it is a DC brushless motor, which is advantageous in life and cost. However, there is no limitation to the kind of the motor to be used, and an AC motor may be used. And the cleaning motor M1 is connected to a gear 75*a* of the gears 75 that are a set of a plurality of gears provided for transmitting drive force to the rotation shafts 71.

An end of each of the rotation shaft 71 is inserted into a corresponding one of shaft bearing portions 74 to be supported thereby. An outer peripheral surface of each of the shaft bearing portions 74 is toothed, and the shaft bearing portions 74 are connected to gears 75*b* and 75*c* of the gears 75. With this structure, when the cleaning motor M1 rotates, the driving is transmitted to the rotation shafts 71 to make them rotate. The rotations of the rotation shafts 71 make the movable bodies 72 move along the length of the glass plates 49 with the cleaning members 73 pressed against the targets to be cleaned (the direction in which the movable bodies 72 move is indicated by hollow double-headed arrows). Thus, as the movable bodies 72 move, the cleaning members 73 wipe the surfaces of the glass plates 49 so as to remove therefrom dust and a substance adhered thereto.

In cleaning the glass plates 49, the movable bodies 72 move along the length of the glass plates 49 from standby positions located close to first ends of the glass plates 49 to reach stoppers (not shown) that are disposed at second ends of the glass plates 49. When the movable bodies 72 reach the stoppers, the cleaning operation is completed. Incidentally, after the movable bodies 72 reach the stoppers, the cleaning motor M1 may be made to rotate backward to allow the movable bodies 72 to move back to the standby positions (that is, allow the movable bodies 72 to reciprocate), and cleaning operation may be completed when the movable bodies 72 return to the standby positions. Thus, the glass plates 49 of the laser unit 41 are cleaned by the movable bodies 72 moving in the above-described manner.

Incidentally, the glass plate cleaning mechanism 7 is provided with : a drive circuit section 76 for switching on/off a power supply to the cleaning motor M1 by using, for example, a transistor; and a current detecting section 77 for detecting a current flowing through the cleaning motor M1, detailed descriptions of which will be given later.

Figure 4A:
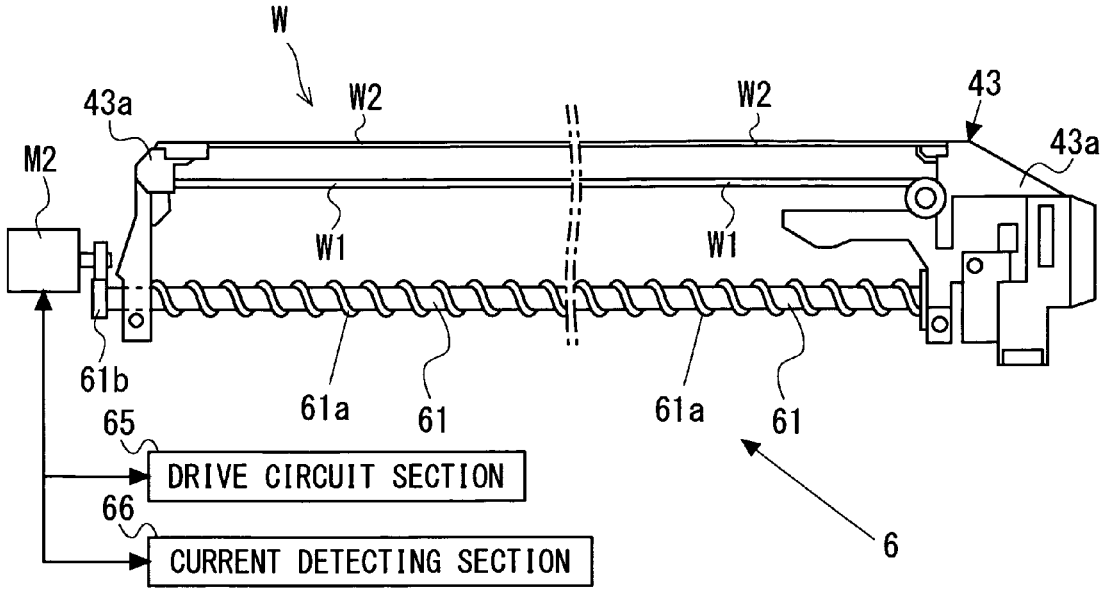
FIG. 4A is a side view showing the inside of a charging device embodying the present invention.
Figure 4B:
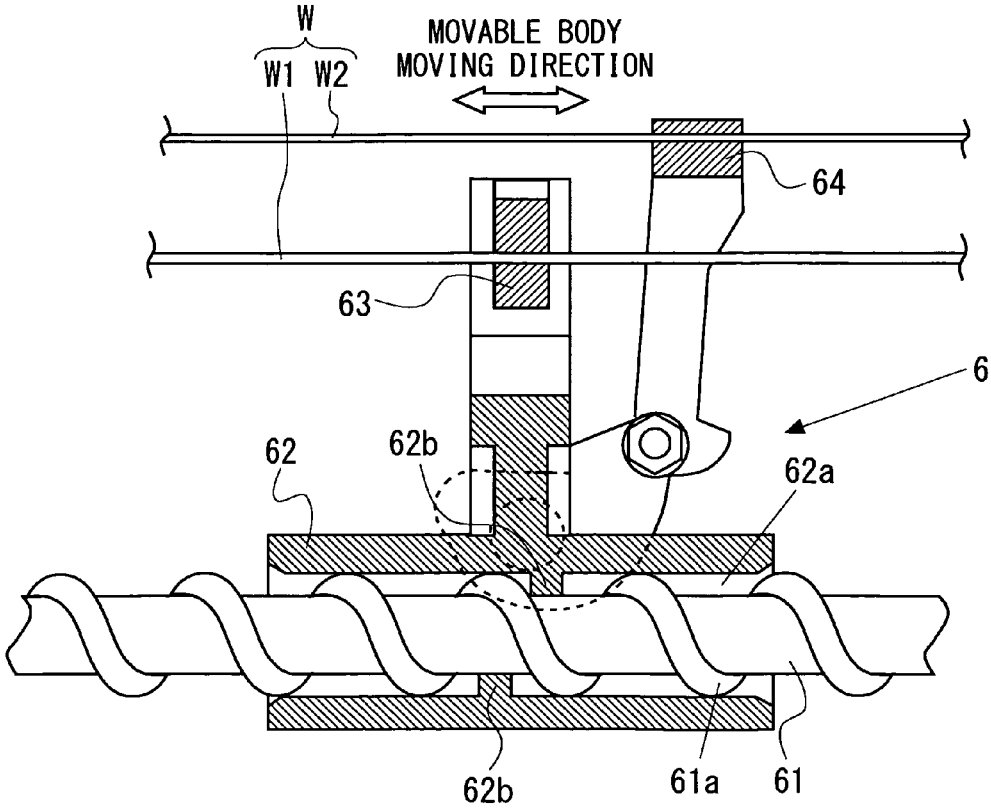
FIG. 4B is an enlarged sectional view showing the structure of a movable body.

Next, a description will be given of the wire cleaning mechanism 6 of the charging device 43 with reference to FIGS. 4A and 4B. FIG. 4A is a side view showing the inside of the charging device 43 embodying the present invention, and FIG. 4B is an enlarged sectional view showing the structure of a movable body 62.

First, reasons will be given why it is necessary to clean the wire W. In the printer 1 of this embodiment, the charging device 43 is provided with the wire W such as the discharge wire W1 to which a high voltage is applied. When a high voltage is applied to the wire W, an electric field is generated around the wire W, and this gives the wire W an attractive force (an electrostatic force). As a result, the wire W attracts dust of, for example, silica contained in toner. The dust sometimes remains to adhere to the wire W. The substance attracted by the wire W hinders preferable charging of the photoconductive drums 42, and thus, degrades the quality of a formed image by causing, for example, uneven image density. Thus, it is necessary to regularly clean the wire W of the charging device 43.

To satisfy the need for cleaning the wire W, the printer 1 of this embodiment is provided with the wire cleaning mechanism 6 formed of components such as a rotation shaft 61, a movable body 62, cleaning members 63 and 64, and a wire cleaning motor M2. Incidentally, cleaning of the wire W may be performed in response to an instruction inputted via the control panel 1*a*, or may be performed every time image formation has been performed on a given number of sheets (for example, every several hundred to several thousand).

The charging device 43 of this embodiment is formed of: a discharge wire W1 and a grid wire W2 that are stretched substantially parallel to the axis line direction of the photoconductive drum 42; and a case in which the discharge wire W1 and the grid wire W2 as a grid electrode are accommodated and a face of which that faces the photoconductive drum 42 is open. A high voltage is applied to the discharge wire W1 and the grid wire W2 to generate corona discharge, which ionizes the ambient air, and thereby the photoconductive drum 42 is charged.

As shown in FIG. 4A, the rotation shaft 61 is rotatably supported by a frame 43*a* of the charging device 43 so as to be substantially parallel to the discharge wire W1 and the grid wire W2. A spiral protrusion (or a spiral groove) 61*a* is formed around the rotation shaft 61. To this rotation shaft 61 is attached a movable body 62 that is provided with two cleaning members, that is, a first cleaning member 63 and a second cleaning member 64 that pinch and clean the discharge wire W1 and the grid wire W2, respectively. Specifically, as shown in FIG. 4B, two protrusions 62*b* are formed inside a path 62*a* that is formed in the movable body 62 and through which the rotation shaft 61 is inserted. The spiral protrusion 61*a* meshes with the protrusions 62*b*, and this allows the movable body 62 to move when the rotation shaft 61 rotates.

The cleaning members (the first and second cleaning members 63 and 64) attached to the movable body 62 may be formed of, for example, sponge so that they will not damage the discharge wire W1 and the grid wire W2. When the movable body 62 moves, the first and second cleaning members 63 and 64 also move, rubbing off substances adhered to the discharge wire W1 and the grid wire W2, respectively. One set of the rotation shaft 61 and the first and second cleaning members 63 and 64 is provided in each of the charging devices 43 of the image forming units 40, and thus, the wire W of each of the charging devices 43 can be cleaned. In other words, a total of four wire cleaning mechanisms 6 are provided in the printer 1 of this embodiment.

On the other hand, at a side face of the charging device 43, the wire cleaning motor M2 is disposed as a drive source for rotating the rotation shaft 61. As in the glass plate cleaning mechanism 7, the wire cleaning motor M2 is a forward/backward rotation motor, and there is no particular limitation to the kind of the motor to be used. The wire cleaning motor M2 is, for example, connected to a toothed surface formed on one end portion 61*b* of the rotation shaft 61 that projects from the frame 43*a* of the charging device 43. Thus, when the wire cleaning motor M2 rotates, the rotation shaft 61 also rotates. Along with this rotation of the rotation shaft 61, the movable body 62 moves in a direction in which the discharge wire W1 is stretched, keeping the first and second cleaning members 63 and 64 in contact with targets to be cleaned.

In cleaning the discharge wire W1 and the like, the movable body 62 moves along the length of the discharge wire W1 from a standby position located close to one end of the discharge wire W1 to reach the other end of the discharge wire W1, when cleaning of the wire W is completed. Thereafter, the cleaning motor M2 may be made to rotate backward to allow the movable body 62 to reciprocate, and cleaning operation may be completed when the movable body 62 returns to the standby position. Thus, the discharge wire W1 and the like are cleaned by the movable body 62 moving in the above-described manner.

As described above, the first cleaning member 63 with which the discharge wire W1 is in contact and the second cleaning member 64 with which the grid wire W2 is in contact are both attached to the movable body 62, and the discharge wire W1 and the grid wire W2 are simultaneously cleaned. This structure makes it possible, in a charging device having two wires W (that is, a discharge wire W1 and a grid wire W2) to simultaneously clean the two wires W, and thereby wire cleaning of the charging device can be securely carried out, as a result of which high quality image formation can be maintained.

Also, as shown in FIG. 4B, since the first and second cleaning members 63 and 64 are arranged in two separate lines along and displaced from each other in a direction in which the movable body 62 reciprocates, when the movable body 62 moves, the first and second cleaning members 63 and 64 arranged in two separate lines reciprocate while being securely pressed against the wires W, and as a result, the wires are securely cleaned.

Incidentally, each of the cleaning mechanisms 6 of this embodiment is provided with: a drive circuit section 65 for switching on/off a power supply to the wire cleaning motor M2 by using, for example, a transistor; and a current detecting section 66 for detecting a current flowing through the wire cleaning motor M2, detailed descriptions of which will be given later.

Figure 5:
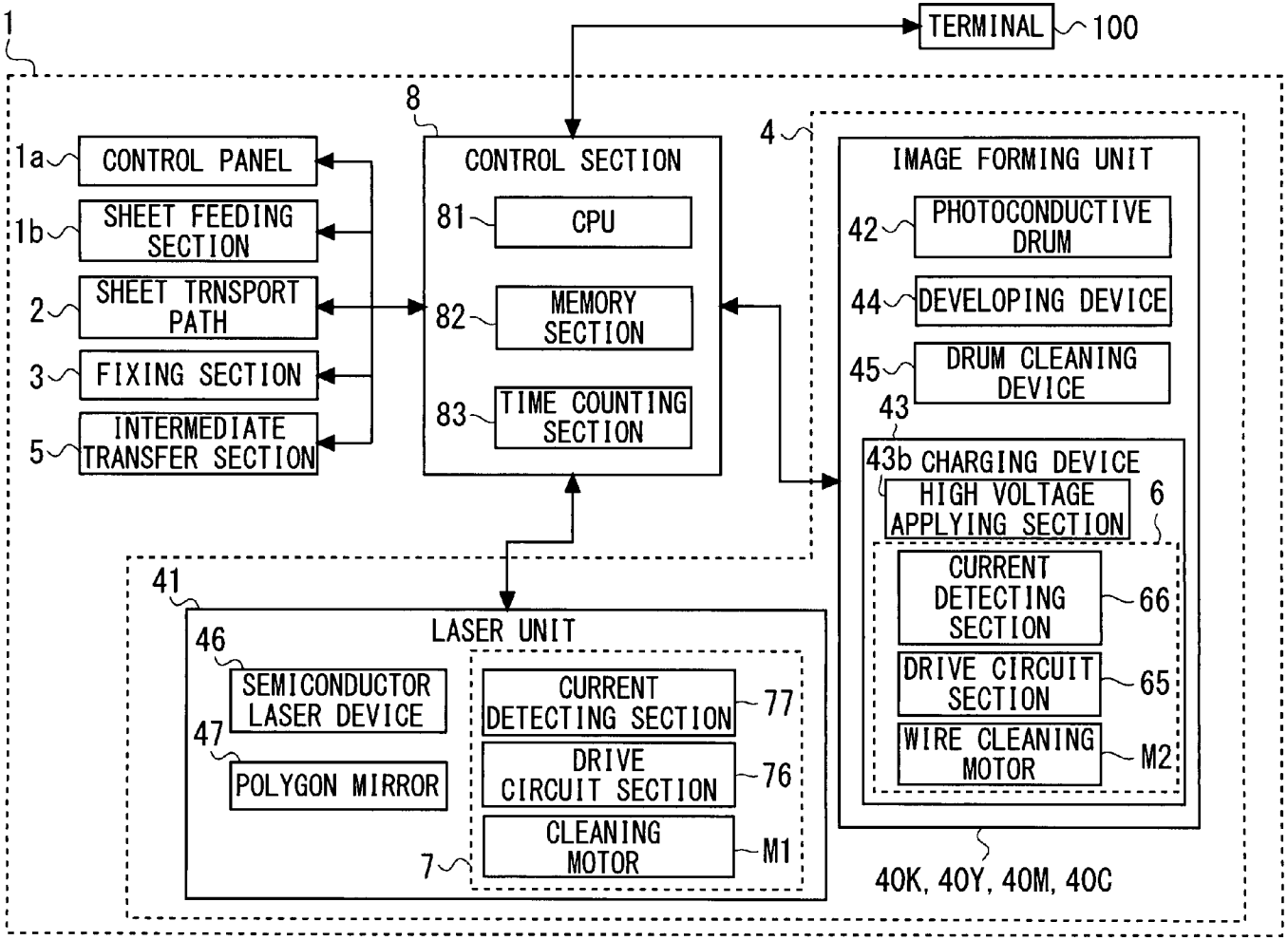
FIG. 5 is a block diagram showing an example of the printer embodying the present invention.

Next, with reference to FIG. 5, a description will be given of a hardware structure of the printer 1 embodying the present invention. FIG. 5 is a block diagram showing an example of the printer 1 embodying the present invention.

As shown in FIG. 5, the printer 1 is connected to one or a plurality of terminals 100 such as a personal computer (only one terminal is shown in FIG. 5 for convenience sake) via, for example, a network. The printer 1 performs image formation on receiving image data and the like from the terminal 100.

And, in order to control the image forming operation of the printer 1, a control section 8 is provided. As shown in FIG. 5, the control section 8 is connected to, for example, the image forming section 4 and the intermediate transfer section 5 of the printer 1 so as to control them. In the present invention, the control section 8 controls rotations of the cleaning motor M1 and of the wire cleaning motor M2 using a set time as a guideline so as to allow the movable bodies 62 and 72 to move to predetermined positions. And, the control section 8 is provided with, as components for actually perfuming control operation, a CPU 81, a memory section 82, a time counting section 83, and the like.

The CPU 81 is a central processing unit, which sends a control signal to each section of the printer 1 and executes operations and the like according to a control program and control data. For example, in the present invention, the CPU 81 executes various operations such as comparison among the drive time of each of the motors M, a set time, and a predetermined time.

The memory section 82 is formed of a ROM (read only memory), a RAM (random access memory, an HDD (hard disk drive), a flash ROM, and the like. The ROM, the HDD, and the flash ROM are nonvolatile memories and used for storing a control program, control data, image data, and the like. The RAM is a volatile memory, and extracts and stores a control program, control data, image data, and the like. For example, in the present invention, the RAM stores time data such as set time data and predetermined time data, and a cleaning operation program.

The time counting section 83 is a so-called timer and counts time that needs to be counted for controlling the printer 1. For example, in the present invention, the time counting section 83 start counting time when the movable bodies 72 of the cleaning mechanism for the laser unit 41 or the movable bodies 62 of the wire cleaning mechanisms 6 for the charging devices 43 start moving and stops counting time when an overcurrent flows through the cleaning motor M1 or the wire cleaning motors M2.

And, as shown in FIG. 5, the laser unit 41 of the image forming section 4 of this embodiment is provided with the above-described cleaning motor M1. The laser unit 41 is further provided with: the current detecting section 77 for detecting a current flowing through the cleaning motor M1 and sending the detection result to the control section 8; and the drive circuit section 76 for switching on/off a power supply to the cleaning motor M1 (that is, turning on/off the rotation of the cleaning motor M1) in response to a cleaning instruction fed from the control section 8.

On the other hand, as described above, the charging devices 43 of the image forming section 4 of this embodiment are each provided with the wire cleaning motor M2. Each of the charging devices 43 is also provided with: the current detecting section 66 for detecting a current flowing through the cleaning motor M2 to send the detection result to the control section 8; and the drive circuit section 65 for switching on/off a power supply to the wire cleaning motor M2 (that is, turning on/off the rotation of the wire cleaning motor M2) in response to a cleaning instruction fed from the control section 8.

The current detecting section 77 detects a voltage between terminals of a resistor (not shown) provided to the cleaning motor M1 and a voltage between terminals of the cleaning motor M1, and according to the detected voltages and a resistance of the cleaning motor M1, calculates a current value. The current detecting sections 66 detects a voltage between terminals of a resistor (not shown) provided to the wire cleaning motor M2 and a voltage between terminals of the wire cleaning motor M2, and according to the detected voltages and a resistance of the wire cleaning motor M2, calculates a current value. Each of the current detecting sections 66 and 77 is connected to the CPU 81 of the control section 8, and sends data of the calculated current value to the control section 8. The control section 8 detects an overcurrent flowing through the cleaning motor M1 and the wire cleaning motor M2 on receiving data from the current detecting sections 77 and 66, respectively. This means that the control section 8 is provided with an overcurrent detection checking function.

Here, a description will be given of a basic control performed in cleaning the glass plates 49 and the wire W (the discharge wire W1 and the grid wireW2) of any one of the charging devices 43. When image formation has been performed on a given number of sheets since last cleaning operation, the control section 8 instructs the drive circuit sections 65 and 76 to drive the cleaning motor M1 and the wire cleaning motor M2 (hereinafter, motors M) such that cleaning of the glass plates 49 and the wire W will be performed. And the time counting section 83 starts counting time at the same time when the motors M start to be driven.

Normally, in cleaning the glass plates 49 and the wire W, the movable bodies 72 and 62 are moved, and when they move from the first ends to reach the second ends of the glass plates 49 and the wire W (when they reach predetermined positions), respectively, the movable bodies 72 and 62 hit the stoppers and the frame 43*a* to stop, respectively, and hence the motors M fall into locked states. And, since torque and the amount of current flowing through each of the motors M are proportional to each other, overcurrents flow through the motors M. The current detecting sections 66 and 77 detect the overcurrents, and then the control section 8 judges that the movable bodies 62 and 72 have reached the predetermined positions. That is, the control section 8 is provided with a predetermined position attainment checking function. Incidentally, in the case where the movable bodies 62 and 72 are designed to reciprocate, the control section 8 instructs the drive circuit sections 65 and 76 to rotate the motors M backward after finding the movable bodies 62 and 72 to have reached the predetermined positions; then, when overcurrents are detected again, the control section 8 finds the movable bodies 62 and 72 to have returned to the standby positions, and makes the cleaning motor M1 and the wire cleaning motor M2 stop.

Incidentally, the predetermined positions here are end points of one-way travels of the movable bodies 62 and 72 along paths along which the movable bodies 62 and 72 move from the standby positions. For example, in the laser unit 41, if the first ends of the glass plates 49 are the standby positions, then the second ends of the glass plates 49 are the predetermined positions. In each of the charging devices 43, if a first end of the wire W is the standby position, then a second end of the wire W is the predetermined position.

As described above, in the printer 1 of this embodiment, it is judged whether or not the movable bodies 62 and 72 have reached the predetermined positions by detecting overcurrents flowing through the motors M; however, an overcurrent may be erroneously detected due to, for example, noise. If the control section 8 judges that the movable bodies 62 and 72 have reached the predetermined positions according to such erroneous detection, cleaning is stopped without being completed. Also, an overcurrent may be erroneously detected due to abnormal torque of the motors M caused by failure of the cleaning mechanisms 6 and 7, and in such a case, it is preferable that power supply be turned off to prevent the motors M from generating heat. The present invention is featured in its capability of making these judgments correctly, which will be described below.

Figure 6:
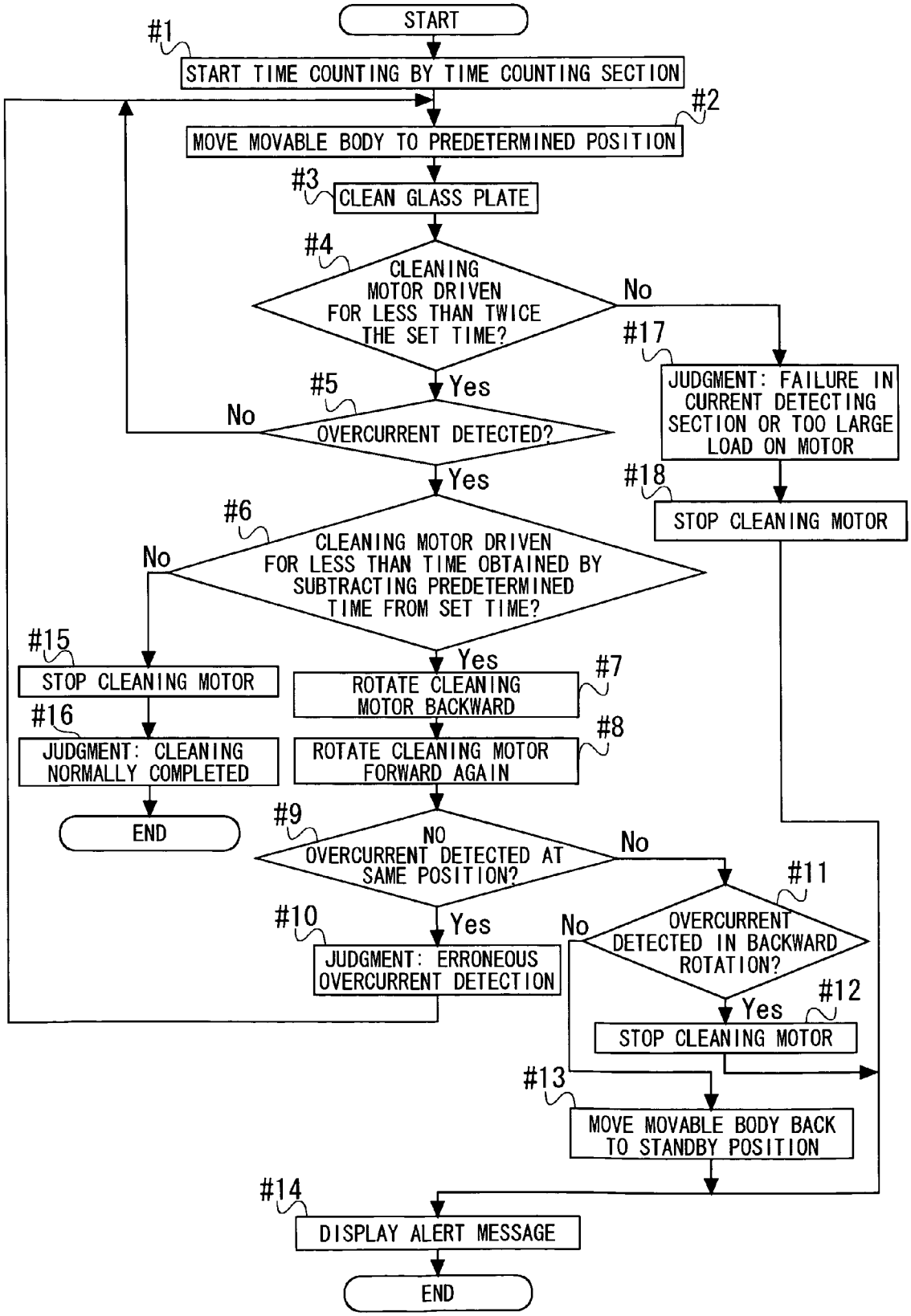
FIG. 6 is a flow chart showing an example of how cleaning is controlled in the printer embodying the present invention.

To describe the capability mentioned above, a description will be given of how cleaning is controlled in the printer 1 of this embodiment with reference to FIG. 6. FIG. 6 is a flow chart showing an example of how cleaning is controlled in the printer 1 embodying the present invention. Incidentally, FIG. 6 deals with control performed in cleaning the glass plates 49 of the laser unit 41, but FIG. 6 can also be referred to in describing how the wire W of each of the charging devices 43 is cleaned.

First, "START" in FIG. 6 indicates the time when the control section 8 gives the drive circuit section 76 an instruction to start cleaning the glass plates 49.

When the cleaning motor M1 starts to be driven, the time counting section 83 starts counting time (step #1). The drive circuit section 76, on receiving the instruction from the control section 8, starts driving the cleaning motor M1, and as a result, the movable bodies 72 move toward the predetermined positions (step #2). As the cleaning motor M1 rotates, the movable bodies 72 move from the first ends toward the second ends of the glass plates 49 to reach the predetermined positions, and thereby, the glass plates 49 are cleaned (step #3) (the rotation of the cleaning motor M1 at this time is "forward rotation"). In the meantime, the control section 8 checks whether or not the cleaning motor M1 has been being driven for a time that is longer than twice the set time (step #4).

Then, in the case where the control section 8 finds the cleaning motor M1 not to have been being driven for a time that is longer than twice the set time ("Yes" in step #4), the control section 8 checks whether or not the current detecting section 77 has detected an overcurrent (step #5). In the case where the control section finds no overcurrent to have been detected ("No" in step #5), the cleaning motor M1 continues to be driven (back to step #2). In the case where the control section finds an overcurrent to have been detected ("Yes" in step #5), the control section checks whether or not the time elapsed from the start of the driving of the motor started to the detection of the overcurrent is shorter than a time obtained by subtracting the predetermined time from the set time (step #6).

Here, the "set time" is a guideline of moving time that is necessary for the movable bodies 72 to move from the standby positions to the predetermined positions. This moving time can be obtained by dividing a distance between any one of the standby positions and the corresponding one of the predetermined positions by an ideal moving speed of the movable bodies 72. Here, the "set time" is used only as a guideline, because a load on the cleaning motor M1 varies depending on factors such as how dirty the glass plates 49 are and attachment conditions of the movable bodies 72 and the cleaning members 73. That is, since rotation of the cleaning motor M1 for a same length of time does not always allow the movable bodies 72 to move a same distance, the guideline of moving time necessary for the movable bodies 72 to move from the first ends to the second ends of the glass plates 49 is used as the "set time".

The "predetermined time" is a time given as a margin for error between an actual drive time of the cleaning motor M1 and the set time, and is set, for example, to two to three seconds. If the drive time of the cleaning motor M1 is shorter than the time obtained by subtracting the predetermined time from the set time ("Yes" in step #6), the time from the start of the driving of the cleaning motor M1 to the detection of the overcurrent is too short for the movable bodies 72 to reach the predetermined positions, and thus cleaning can be judged not to have been completed. That is, in step #6, whether or not an expression "T1−T2>t" is satisfied is checked, the symbols T1, T2, and t representing the set time, the predetermined time, and the drive time of the cleaning motor M1, respectively. That is, the control section 8 is provided with a predetermined time checking function.

If the answer at step #6 is "Yes", it suggests that the current detecting section 77 has erroneously detected some noise from, for example, high voltages of the charging devices 43 and the transfer rollers and rubbing of sheets, that too large a load is imposed on the cleaning motor M1, or that a failure has occurred in the cleaning mechanisms. To find out the situation, the control section 8 instructs the drive circuit section 76 to rotate the cleaning motor M1 backward, and thus the cleaning motor M1 is rotated backward (step #7). Here, the cleaning motor M1 is rotated backward preferably for two to seven seconds, more preferably for three to six seconds, and still more preferably for about five seconds.

Then, the control section 8 makes the cleaning motor M1 rotate forward again (step #8). That is, the control section 8 is provided with a reciprocation controlling function. Then, the control section 8 checks whether or not an overcurrent is detected at the same position at which an overcurrent was detected in step #5 (step #9). That is, the operation performed in steps #7 to #9 is erroneous overcurrent detection checking operation, and thus the control section is provided with an erroneous overcurrent detection checking function. Incidentally, for the purpose of achieving more accurate checking, steps #7 to #9 may be repeated for a plurality of times (for example, three times). In summary, when the current detecting section 77 has detected an overcurrent flowing through the cleaning motor M1, if the drive time of the cleaning motor M1 from the start of the driving of the cleaning motor M1 to the detection of the overcurrent is shorter than the time obtained by subtracting the predetermined time from the set time, the control section 8 performs erroneous detection checking operation once or a plurality of times, in which the control section 8 makes the cleaning motor M stop rotating, then rotate backward for a given time, and then rotate forward again. That is, the control section 8 is provided with a repeating function for repeating the erroneous detection checking operation.

If no overcurrent is detected again ("Yes" in step #9), the control section 8 judges that the overcurrent detection in step #5 is erroneous (step #10), and allows the cleaning motor M1 to continue rotating forward to move the movable bodies 72 toward the predetermined positions (back to step #2).

If an overcurrent is detected again, ("No" in step #9), the control section 8 checks whether or not an overcurrent was also detected while the cleaning motor M1 was rotating backward (step #11). Detection of an overcurrent both while the cleaning motor M1 is rotating forward and while it is rotating backward suggests that the cleaning motor M1 is prevented from moving, that too large a load is imposed on the cleaning motor M1, or that a failure has occurred in the cleaning mechanism. Also, an overcurrent continues flowing through the cleaning motor M1 whether it is made to rotate forward or backward, and this may cause the cleaning motor M1 to be overheated.

To prevent this, in the erroneous detection checking operation, if an overcurrent is detected both while the cleaning motor M1 is rotating forward and while it is rotating backward ("Yes" in step #11), the control section 8 instructs the drive control section 76 to make the cleaning motor M1 stop rotating (step #12). Then, the control section 8 makes use of the liquid crystal display section of the control panel 1*a* and a printer driver software installed in the terminal 100 connected to the printer 1, and make them display an alert message such as "Error. Please call a repair service" (step #14). Then, the cleaning control is finished (End).

On the other hand, if no overcurrent is detected while the cleaning motor M1 is rotating backward ("No" in step #11), in order to at least make it possible for image formation to be performed, the control section 8 makes the cleaning motor M1 rotate backward to make the movable bodies 72 move back to the standby positions (step #13). That is, in the erroneous detection checking operation, if the current detecting section 77 detects an overcurrent flowing through the cleaning motor MI, the control section 8 makes the cleaning motor M1 rotate backward to make the movable bodies 72 move back to the standby positions. And, the control section 8 makes the liquid crystal display device and the like display an alert message such as "Cleaning is not completed. Trouble in the cleaning mechanism. Please call a repair service" (step #14). Then, the cleaning control is finished (End).

Back in step #6, if the drive time of the cleaning motor M1 is not shorter than the time obtained by subtracting the predetermined time from the set time ("No" in step #6), the cleaning motor M1 is made to stop rotating (step #15), and the control section 8 judges that the cleaning has been normally performed (step #16). In other words, in this case, the drive time of the cleaning motor M1 is judged to be within an acceptable range. That is, when the answer is "No" in step #6, an expression "T1−T2<t" is satisfied, the symbols T1, T2, and t representing the set time, the predetermined time, and the drive time of the cleaning motor M1, respectively. Then, the cleaning control is finished (End).

Also, back in step #4, if the drive time of the cleaning motor M1 is longer than twice the set time (or longer than an integral multiple of the set time, or longer than a maximum allowable drive time of the cleaning motor M1) ("No" in step 4), the time that elapses before detection of an overcurrent is too long. Judging that this situation has been caused by failure of the current detecting section 77 or by too large a load on the cleaning motor M1 (step #17), the control section 8 stops the cleaning motor M1 (step #18), and makes the liquid crystal display section display a massage such as "Failure in the cleaning mechanisms. Please call a repair service" (step #14). Thus, the control section 8 continues driving the cleaning motor M1 until the cleaning operation is completed as long as the drive time of the cleaning motor M1 does not exceed twice the set time. That is, in the case where the set time has elapsed without the current detecting section 77 detecting an overcurrent flowing through the cleaning motor M1, the control section 8 allows the cleaning motor M1 to continue rotating until an overcurrent is detected; however, if, for example, twice the set time has elapsed since the start of the driving of the cleaning motor M1 without the current detecting section 77 detecting an overcurrent flowing through the cleaning motor M1, the control section 8 makes the cleaning motor M1 stop rotating.

Incidentally, in the case where the movable bodies 72 are designed to reciprocate in the cleaning operation, the same control as described above should be performed with the standby positions and the predetermined positions switched. The above description given with reference to FIG. 6 can be applied to the cleaning operation of the wire W of each of the charging devices 43 by substituting "discharge wire W1 and grid wire W2", "drive circuit section 65", "wire cleaning motor M2", "movable body 62", "current detecting section 66", "cleaning members 63 and 64", and "wire cleaning mechanism 6" for "glass plates 49", "drive circuit section 76", "cleaning motor M1", "movable bodies 72", "current detecting section 77", "cleaning member 73", and "glass plate cleaning mechanism 7", respectively.

As described above, the control section 8 of the present invention is provided with: the overcurrent detection checking function for checking that the current detecting sections 66 and 77 have detected an overcurrent flowing through the motors M; the motor drive time checking function for checking that the motor drive time of each of the motors M from a start of the driving thereof to detection of an overcurrent is shorter than a time obtained by subtracting the predetermined time from the set time; the predetermined position attainment checking function for checking via the motor drive time checking function whether or not the movable body is positioned at the predetermined position when the overcurrent is detected; the reciprocation control function for making the motors M stop rotating to make the motors M rotate backward for a given time and then rotate forward again when it is checked that the motor drive times from the start of the driving of the motors M to the detection of the overcurrent is shorter than the time obtained by subtracting the predetermined time from the set time; the erroneous overcurrent detection checking function for performing erroneous detection checking operation for checking, in the case where an overcurrent was detected while the movable bodies were moving forward in reciprocation thereof, whether or not an overcurrent is also detected while the movable bodies are moving backward in the reciprocation thereof; and the repeating function for performing erroneous overcurrent detection checking operation once or a plurality of times in a repeating fashion.

According to this structure, as has been described hitherto, since the erroneous detection checking operation is performed once or repeated a plurality of times, erroneous detection of an overcurrent caused by, for example, noise can be detected without fail. Also, instead of driving each of the motors M only for the set time in cleaning operation as has been conventionally done, the predetermined time is provided as a margin for error between an actual drive time of each of the motors M and the set time, cleaning operation can securely be completed. Thus, it is possible to securely prevent cleaning operation from being stopped before the movable bodies 62 and 72 move to the predetermined positions.

Also, in the case where an overcurrent is detected again in the erroneous detection checking operation, there may have occurred a problem such as too large a load. However, in this case, since the movable bodies 62 and 72 are moved back to the standby positions, at least it is possible to prevent image formation from being interfered with. It is also possible to prevent the motors M from being overheated by overcurrents continuing to flow therethrough due to abnormal torque. Also, in the case where overcurrents are detected flowing through the motors M both while the motors M are rotating forward and while they are rotating backward, where there may have occurred failure of the mechanisms for moving the movable bodies 62 and 72, it is possible to prevent the overcurrents from continuing to flow through the motors M for a long time Also, if no overcurrent has been detected flowing through the motors M when the predetermined time has elapsed in addition to the set time, it suggests that too large loads have lowered the moving speeds of the movable bodies 62 and 72. In this case, it is possible to move the movable bodies 62 and 72 to the predetermined positions by allowing the motors M to continue rotating until an overcurrent is detected, and thereby the cleaning operation can be prevented from being stopped halfway. On the other hand, if no overcurrent has been detected flowing through the motors M when a time twice as long as the predetermined time has elapsed since the set time elapsed, it suggests that failure has occurred in the current detecting sections 66 and 77 or that the load is too large, and overcurrents may continue flowing through the motors M. However, in this case, the control section 8 stops driving the motors M so as to prevent the motors from being overheated.

Also, since the control panel 1*a* (display section) displays the alert messages, in the case where the cleaning members 63, 64, and 73 cannot perform satisfactory cleaning operation, the user can recognize that image formation will be negatively affected, and in the case where overcurrents flow through the motors M more than necessary, the user can be informed of necessity of checking the cleaning mechanisms. Specifically, the glass plates 49 (plate members) of the laser unit 41 (exposure device) can be securely cleaned with out being negatively affected by, for example, noise, and thus high-quality image formation can be maintained.

The descriptions given above of the embodiment of the present invention are not meant to limit the scope of the present invention, and in the practice of the present invention, various modifications may be made within the scope of the present invention.

The present invention is applicable to an image forming apparatus that automatically cleans, for example, a charging device and a laser unit thereof by using a motor.

What is claimed is:

1. An image forming apparatus comprising:

a rotatably-supported rotation shaft around which a spiral protrusion or a spiral groove is formed;

a movable body that is attached to the rotation shaft, that is provided with a cleaning member, and that moves with rotation of the rotation shaft, keeping the cleaning member in contact with a target to be cleaned;

a forward/backward rotation motor for rotating the rotation shaft;

a control section for controlling rotation of the motor using a set time as a guideline such that the movable body moves to a predetermined position in cleaning operation;

a current detecting section for detecting a current flowing through the motor; and a time counting section for counting time, wherein the control section is provided with:

an overcurrent detection checking function for checking that the current detecting section has detected an overcurrent flowing through the motor;

a motor drive time checking function for checking that motor drive time from a start of driving of the motor to detection of an overcurrent is shorter than a time obtained by subtracting a predetermined time from the set time;

a predetermined position attainment checking function for checking via the motor drive time checking function whether or not the movable body is positioned at the predetermined position when the overcurrent is detected;

a reciprocation control function for making the motor stop rotating to make the motor rotate backward for a given time and then rotate forward again when it is checked that the motor drive time from the start of the driving of the motor to the detection of the overcurrent is shorter than the time obtained by subtracting the predetermined time from the set time;

an erroneous overcurrent detection checking function for performing erroneous detection checking operation for checking, in a case where an overcurrent was detected while the movable body was moving forward in reciprocation thereof, whether or not an overcurrent is also detected while the movable body is moving backward in the reciprocation thereof; and a repeating function for performing erroneous overcurrent detection checking operation once or a plurality of times in a repeating fashion.

2. The image forming apparatus of claim 1, wherein the control section makes the motor stop rotating in a case where an overcurrent is detected flowing through the motor both in forward and backward rotations thereof in the erroneous detection checking operation.

3. The image forming apparatus of claim 1, wherein in the erroneous detection checking operation, when an overcurrent is detected flowing through the motor by the current detecting section, the control section makes the motor rotate backward so as to make the movable body move to a standby position.

4. The image forming apparatus of claim 3, wherein the control section makes the motor stop rotating in a case where, in the erroneous detection checking operation, an overcurrent is detected flowing through the motor both while the motor is rotating forward and while the motor is rotating backward.

5. The image forming apparatus of claim 1, wherein the control section makes the motor continue rotating until an overcurrent is detected in a case where the current detecting section has not detect an overcurrent flowing through the motor when the set time has elapsed.

6. The image forming apparatus of claim 1, wherein the control section makes the motor stop rotating in a case where the current detecting section has not detected an overcurrent flowing through the motor when a time twice as long as the set time has elapsed from a start of driving of the motor.

7. The image forming apparatus of claim 1, comprising a display section for displaying a state of the apparatus, wherein the display section displays an alert message in a case where the current detecting section detects an overcurrent flowing through the motor in the erroneous detection checking operation.

8. The image forming apparatus of claim 1, comprising for forming a toner image:

a photoconductive drum functioning as an image carrier; and an exposure device that performs scanning and exposure of the photoconductive drum by use of laser light according to image data of an image to be formed, wherein a plate-shaped member that transmits light is attached to the exposure device at a portion thereof from which laser light is emitted toward the photoconductive drum, the plate-shaped member is in contact with the cleaning member of the movable body, and the plate-shaped member is the target to be cleaned.

9. The image forming apparatus of claim 1, comprising for forming a toner image:

a photoconductive drum functioning as an image carrier; and a charging device for charging the photoconductive drum, wherein the charging device is provided with a discharge wire that is stretched along an axial line direction of the photoconductive drum, the discharge wire is in contact with the cleaning member of the movable body, and the discharge wire is the target to be cleaned.

10. The image forming apparatus of claim 9, wherein the charging device is provided with a discharge wire and a grid wire that are stretched along the axial line direction of the photoconductive drum substantially parallel to each other, the discharge wire and the grid wire are each the target to be cleaned, and a first cleaning member with which the discharge wire is in contact and a second cleaning member with which the grid wire is in contact are attached to the movable body such that the discharge wire and the grid wire are simultaneously cleaned.

11. The image forming apparatus of claim 10, wherein the first cleaning member and the second cleaning member are arranged in two lines along and displaced from each other in a direction in which the movable body reciprocates.

* * * * *